US009339157B2

(12) United States Patent
Sarkar

(10) Patent No.: US 9,339,157 B2
(45) Date of Patent: May 17, 2016

(54) PADDED SEAT COVER

(71) Applicant: Ivette Sarkar, Westlake, OH (US)

(72) Inventor: Ivette Sarkar, Westlake, OH (US)

( * ) Notice: Subject to any disclaimer, the term of this patent is extended or adjusted under 35 U.S.C. 154(b) by 485 days.

(21) Appl. No.: 13/865,632

(22) Filed: Apr. 18, 2013

(65) Prior Publication Data

US 2013/0298322 A1 Nov. 14, 2013

Related U.S. Application Data

(60) Provisional application No. 61/625,928, filed on Apr. 18, 2012.

(51) Int. Cl.

| | |
|---|---|
| ***A47K 13/14*** | (2006.01) |
| ***A47K 13/06*** | (2006.01) |
| ***B68G 7/06*** | (2006.01) |
| ***A47K 13/00*** | (2006.01) |

(52) U.S. Cl.

CPC ..... *A47K 13/14* (2013.01); *A47K 13/005* (2013.01); *A47K 13/06* (2013.01); *B68G 7/06* (2013.01); *Y10T 29/481* (2015.01)

(58) Field of Classification Search

CPC ..... A47K 13/14; A47K 13/16

USPC ..... 4/244.3, 245.1, 245.6–245.7

See application file for complete search history.

(56) References Cited

U.S. PATENT DOCUMENTS

| | | | | |
|---|---|---|---|---|
| 3,073,937 | A | 1/1963 | Easley | |
| 3,514,156 | A * | 5/1970 | Fields | B62J 1/00 297/452.45 |
| 3,514,793 | A * | 6/1970 | West | A47C 7/021 4/239 |
| 3,587,119 | A * | 6/1971 | Freses | A47K 13/02 4/245.5 |
| 3,671,981 | A * | 6/1972 | Smith | A47K 13/005 4/239 |
| 5,613,730 | A | 3/1997 | Buie et al. | |
| 5,619,757 | A * | 4/1997 | Baratta | A47K 13/14 4/239 |
| 5,833,309 | A | 11/1998 | Schmitz | |
| 5,987,656 | A * | 11/1999 | Kakutani | A47K 13/14 4/245.3 |
| 6,036,261 | A | 3/2000 | Woods et al. | |
| 6,996,859 | B1 * | 2/2006 | Alonso | A47K 13/14 4/244.1 |
| 7,819,484 | B2 | 10/2010 | Conforti | |
| 2006/0168715 | A1 | 8/2006 | Brown | |
| 2007/0266487 | A1 | 11/2007 | Kim | |

* cited by examiner

*Primary Examiner* — Tuan N Nguyen

(74) *Attorney, Agent, or Firm* — Fay Sharpe LLP

(57) ABSTRACT

A padded seat cover for use on a toilet seat which encourages users with sensory integration issues, Autism or ADHD to remain on the toilet. The padded seat cover has a textured top layer, a bottom layer, and a middle layer disposed between the top and bottom layer. The top, bottom, and middle layers completely and securely cover the toilet seat when a user sits on the padded seat cover, preventing contact of the user's skin with a toilet seat. The top layer has a textured surface formed by cavities and the cavities provide even heat distribution across the padded seat cover. The bottom layer has a gripping member for removably connecting the padded seat cover to a toilet seat. The middle layer provides cushioning making the padded seat cover more comfortable for the user.

13 Claims, 3 Drawing Sheets

PADDED SEAT COVER

CLAIM OF PRIORITY

This application claims priority from Provisional Patent Application Ser. No. 61/625,928, filed on Apr. 18, 2012, the entirety of which is hereby incorporated by reference.

BACKGROUND OF THE DISCLOSURE

The present disclosure relates to padded seat pad. It finds particular application in conjunction with a toilet seat, and will be described with particular reference thereto.

Toilet seat covers have been available for a number of years. The most common is a disposable toilet seat cover which comprises a single sheet of paper of a size to cover a toilet seat, with a cutout central portion detachably secured at one end to the outer portion which hangs down into the bowl to aid in drawing the seat cover down the drain when the toilet is flushed. That device, however, does not provide means to completely and securely cover a toilet seat, totally preventing the user's skin contact with the toilet seat. It tears easily, is not wipeable when damp, and tends to soak in moisture.

While the paper tissue covers may be suitable for a single use, they are not suitable for repeated use by an individual over an extended period of time. When the conventional tissue seat covers are used, they tend to dislodge or shift after they have been placed on seats, resulting in imperfect covering and discomfort or exposure to the toilet seat. Edges of the public toilet seat may be exposed by shifting of the cover.

Another common problem with toilet seats and toilet seat covers is the initial surface temperature of the seat or cover when a user sits down. When a user initially sits on a toilet seat, the surface temperature of the seat may cause discomfort from having a surface temperature that is colder or warmer than the room temperature. A number of known toilet seats have attempted to fix this problem by heating the toilet seat. For example in U.S. Pat. No. 3,073,937 a single strand of heating wire is aligned with the configuration of the seat. The heating wire is placed in a downwardly open groove which is then filled with a heat resistant material. Among other things, this seat has uneven heat distribution, inconsistent surface temperature control, and aesthetic problems.

Thus, it can be seen that a need exists for a padded seat cover 16 that avoids the shortcomings of the known prior art while providing additional advantages and benefits. There is a need for a padded seat cover which accommodates children or adults who are sensitive to hot or cold temperatures.

SUMMARY OF THE DISCLOSURE

The present embodiments include a seat cover having a textured top layer, a middle layer, and a bottom layer each with an inner edge and outer edge. A gripping member is attached to the bottom layer, which serves to enable the user to attach and detach the padded seat cover to a standard toilet seat. In one embodiment of the padded seat cover, the top layer is a textured surface formed from a non-adhering water-resistant material with a plurality of cavities filled with fluid for maintaining a room temperature surface. This embodiment is particularly fit for users with sensory sensitivity such as touch, which benefit from a padded seat cover that does not adhere to the skin and maintains a room temperature surface to sit on. However, this embodiment may also be used for different purposes as well In accordance with one aspect of the disclosure, a padded seat cover for covering a toilet seat which prevents a user's skin from directly contacting a toilet seat includes a top layer having an outer edge portion and an inner edge portion disposed substantially uniformly therefrom, where the top layer further extends between the inner edge and outer edge portions, the top layer includes a textured surface. A bottom layer has an outer edge portion and an inner edge portion disposed substantially uniformly therefrom, where the bottom layer further extends between the inner and outer edge portions. A gripping member is attached to the bottom layer for removably securing the padded seat cover onto a toilet seat. A middle layer is disposed between the top layer and bottom layer, where the middle layer further extends between the inner and outer edge portions of the top and bottom layer. A plurality of cavities is disposed substantially uniformly across the top layer and extending through at least the top layer, where the plurality of cavities evenly maintain the padded seat cover at room temperature.

In accordance with another aspect of the disclosure, a method for making a padded seat cover includes the steps of providing a top layer having an outer edge portion and an inner edge portion being disposed substantially uniformly therefrom, the top layer further extending between the inner edge and outer edge portions, the top layer including a textured surface, providing a bottom layer having an outer edge portion and an inner edge portion being disposed substantially uniformly therefrom, the bottom layer further extending between the inner and outer edge portions, attaching a gripping member to the bottom layer for removably securing the padded seat cover onto a toilet seat, providing a middle layer being disposed between the top layer and bottom layer, the middle later further extending between the inner and outer edge portions of the top and bottom layer, and providing a plurality of cavities being disposed substantially uniformly across the top layer and extending through at least the top layer, where the plurality of cavities evenly maintain the padded seat cover at room temperature.

Other aspects of the disclosure will become apparent upon a reading and understanding of the following detailed description.

BRIEF DESCRIPTION OF THE DRAWINGS

The following is a brief description of the drawings, which are presented for the purpose of illustrating the exemplary embodiments disclosed herein and not for the purpose of limiting the same

DETAILED DESCRIPTION OF THE DISCLOSURE

In view of the foregoing disadvantages inherent in the known types of toilet seats and toilet seat covers present in the prior art, the present disclosure provides a new padded seat cover 16 wherein the same can be utilized for providing a safe means of normalizing the surface temperature of a padded seat cover 16 as well as securing and sanitizing a padded seat cover 16 to a toilet seat.

Figure 1:
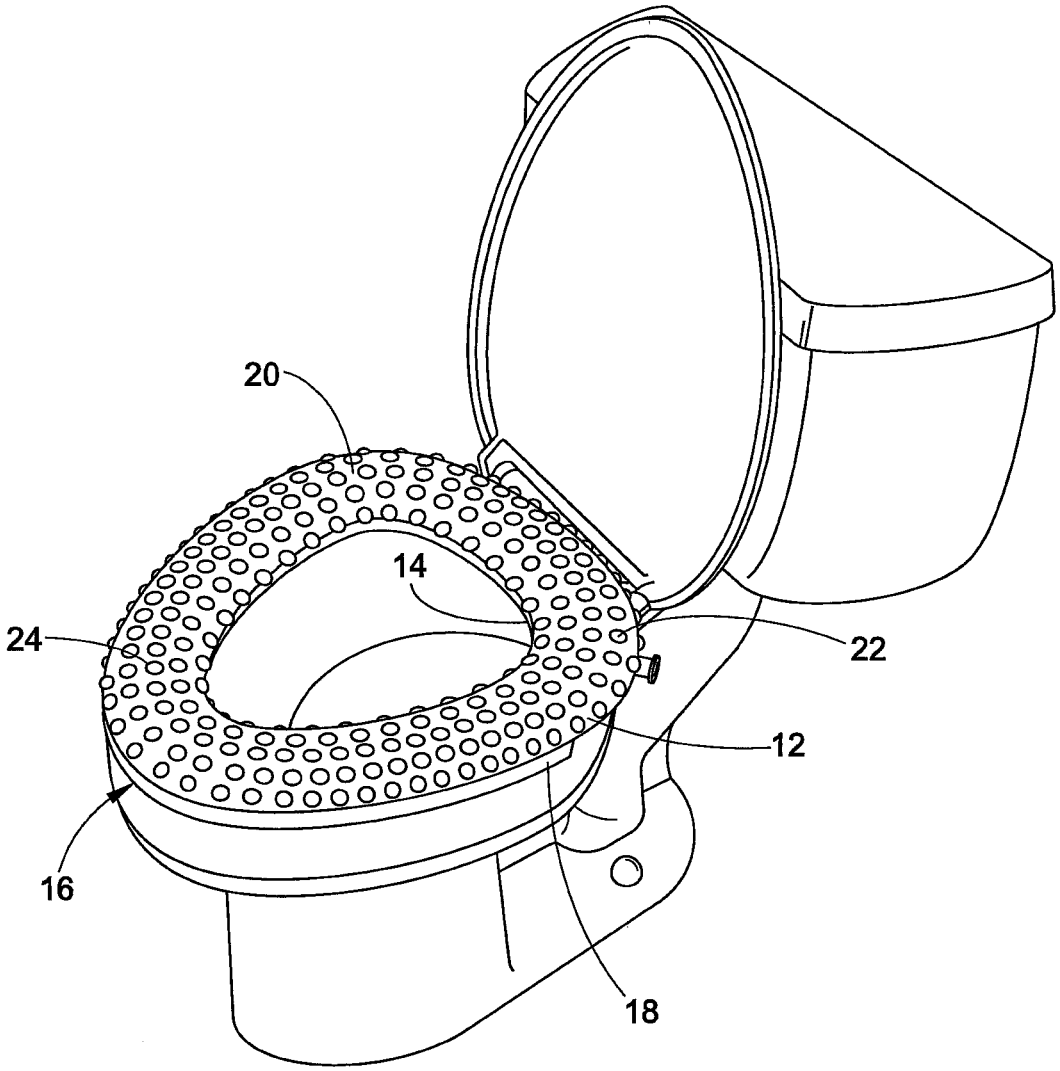
FIG. 1 is a perspective view of the padded seat cover of the disclosure in its usable form applied to a toilet seat.

With reference to FIG. 1 these and other objects, features, and advantages of the present disclosure are provided by a padded seat cover 16 including a top layer 20 having an outer edge 12 portion and an inner edge 14 portion disposed substantially uniformly therefrom. The top layer 20 further extending between the inner edge 14 and outer edge 12 portions. The top layer 20 preferably has a textured surfaces with ribs or protrusions 22.

The padded seat cover 16 further includes a bottom layer 18 having an outer edge 12 portion and an inner edge 14 portion disposed substantially uniformly therefrom. Likewise, the bottom layer 18 further extending between the inner and outer edge 12 portions thereof.

Figure 4:
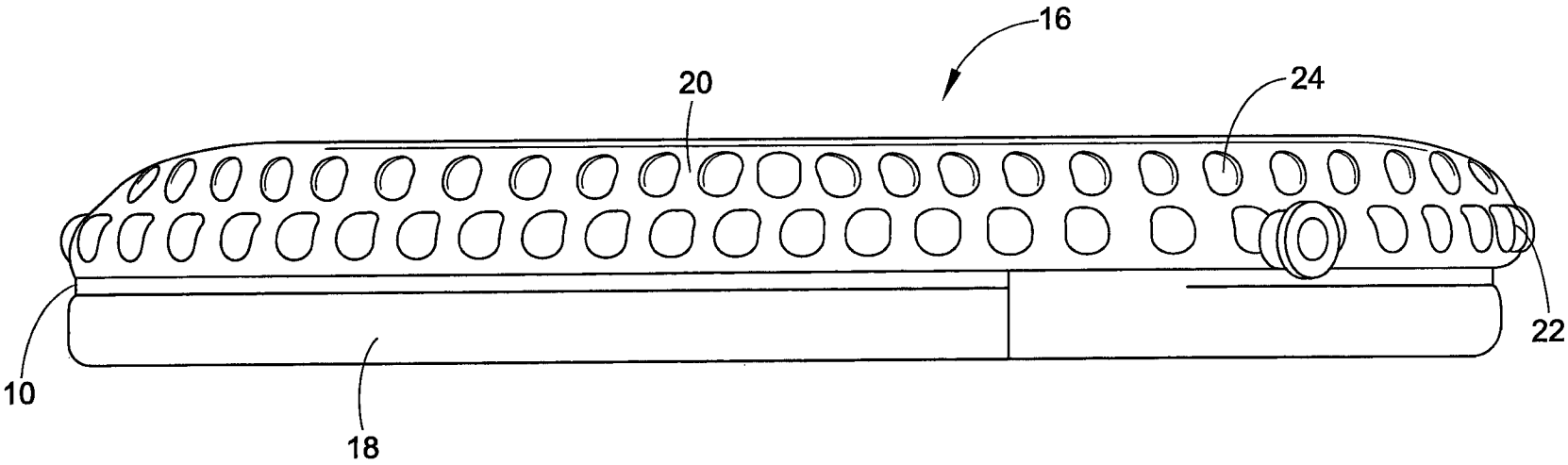
FIG. 4 is a side view of the padded seat cover of the disclosure.

With reference to FIG. 4, the padded seat cover 16 further includes a middle layer 10 disposed between the top layer 20 and bottom layer 18. The middle layer 10 is preferably formed from a cushioning material such as foam, gel, or other natural fibers. Alternatively the middle layer 10 may be a hollow cavity filled with air, or a cavity filled with fluid or liquid. The hollow cavity is capable of being inflated by the user. Alternatively, the cover may be solid and formed of a single material such as foam.

Figure 2:
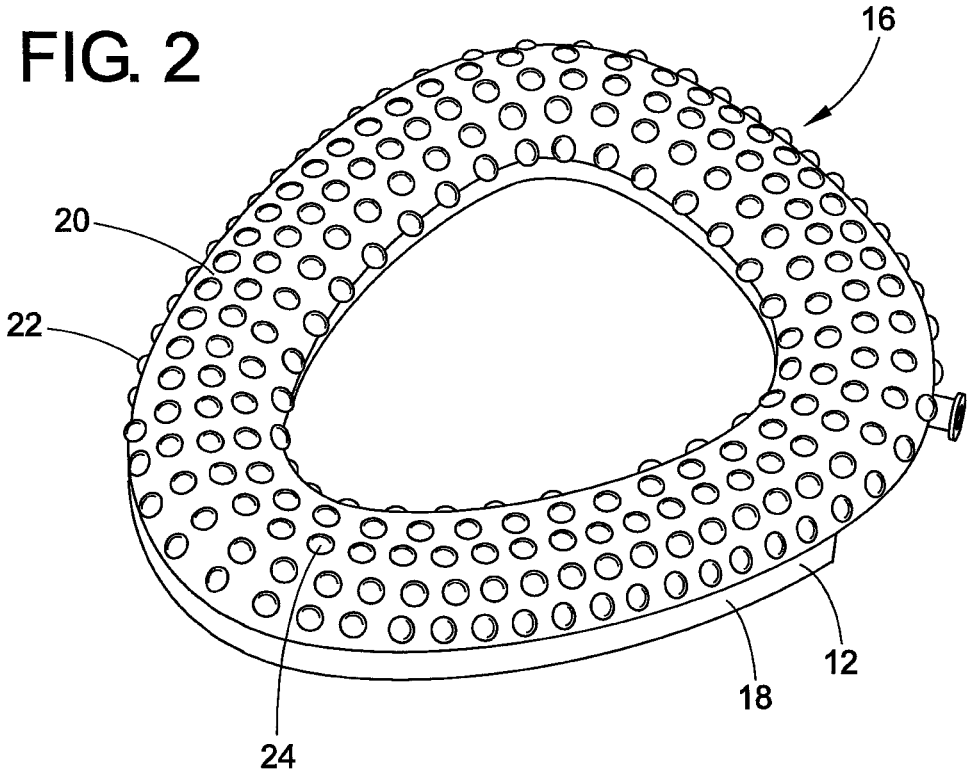
FIG. 2 is a perspective top view of the padded seat cover of the disclosure.
Figure 3:
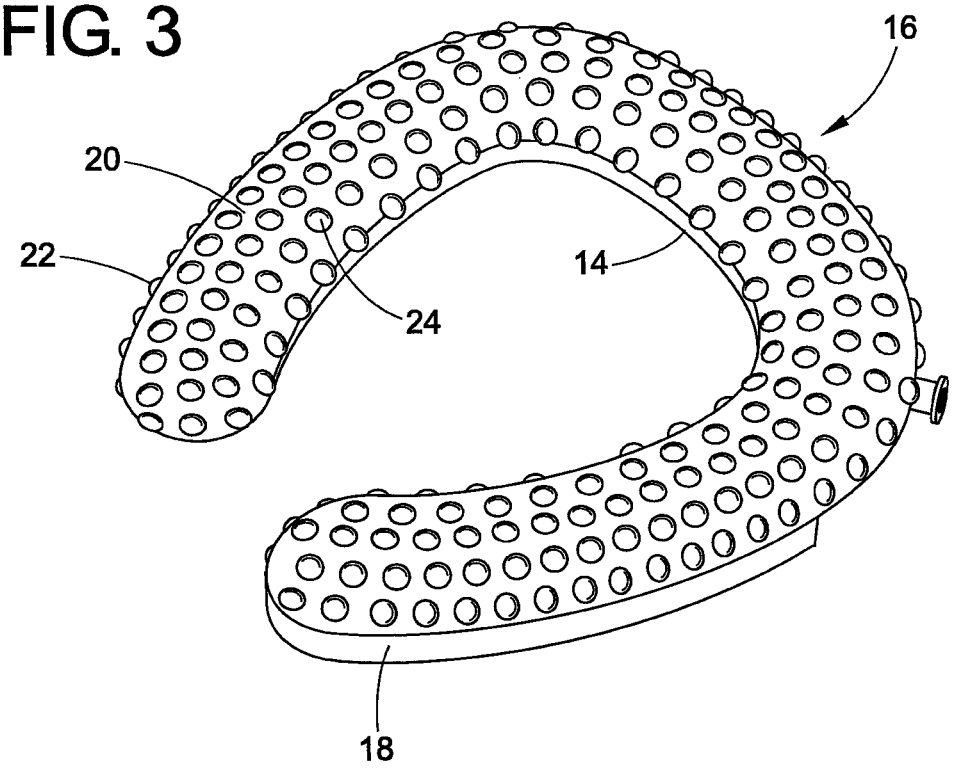
FIG. 3 is a perspective top view of another version of the padded seat cover of the disclosure.

With reference to FIG. 2 or 3, the padded seat cover 16 further includes a means for removably attaching the padded seat cover 16 onto a toilet seat. The padded seat cover 16 preferably includes a gripping member 10 attached to the bottom layer 18 of the padded seat cover 16 which secures the padded seat cover 16 to the toilet seat so that the padded seat cover 16 does not become detached therefrom the toilet seat while a user is seated on the padded seat cover 16. The padded seat cover 16 may be shaped to removably attach to any standard toilet seat. In one embodiment, the gripping member is a lip that forms around the toilet seat to secure the padded seat cover to the toilet seat. In another embodiment, the gripping member is a sleeve or apron capable of securing to toilet seats of various sizes.

As shown in FIGS. 1-3, the top layer 20 is preferably a textured surface formed from a non-adhering water-resistant material such as an elastomer, polymer, or silicone for preventing water from passing there through. The textured surface aids in preventing the user's skin from sticking to the padded seat cover. Additionally, the top layer 20 may be formed from a non-slip material to prevent the user from sliding off the padded seat cover 16. Alternatively, the top layer 20 may be formed from foam or gel to provide a cushion for the user of the padded seat cover 16. Likewise, the bottom layer 18 is preferably formed from a non-adhering water-resistant material such as an elastomer, polymer, or nylon for preventing water from passing there through. Alternatively, the bottom layer 18 may be formed from foam or gel to provide a cushion for the user of the padded seat cover 16. Additionally, the non-adhering water-resistant material may allow for the padded seat cover 16 to be easily clean and sanitized.

The top layer 20 may include a textured surface with a plurality of cavities such as hollow pockets or cavities 24 such as between ribs or instead of ribs filled with fluid for maintaining a room temperature surface. The plurality of pockets may also provide a surface that forms to the seat of the user yet maintains a non-adhesive surface. Alternatively, the top layer 20 may include a plurality of hollow cavities. The plurality of cavities may extend through at least the top layer to ensure even heat distribution of the padded seat cover.

Furthermore, a method for making padded seat cover 16 preferably includes providing a top layer 20 having an outer edge 12 portion and an inner edge 14 portion disposed substantially uniformly therefrom wherein the top layer 20 further has an upper surface and a lower surface extending between the inner and outer edge 12 portions. The method further includes providing a bottom layer 18 having an outer edge 12 portion and an inner edge 14 portion disposed substantially uniformly therefrom wherein the bottom layer 18 further has an upper surface and a lower surface extending between the inner and outer edge 12 portions. The method further includes positioning a middle layer 10 between the top layer 20 and bottom layer 18 and disposed between the inner and outer portions of the top layer 20 and bottom layer 18. The method further includes providing an gripping member for removably attaching the padded seat cover 16 onto a toilet seat so that the padded seat cover 16 does not become detached therefrom while a user is seated the padded seat cover 16.

The padded seat cover 16 is especially useful to users such as children who may have a sensory sensitivity such as touch or are extremely sensitive to hot or cold temperatures. The padded seat cover 16 can be used by users to avoid a toilet seat with a surface warm or cold temperature. Additionally, users can use the padded seat cover 16 to avoid a hard or adhering surface. The padded seat cover 16 is also useful for users who are traveling. Where the padded seat cover 16 can removably attach to standard toilet seats, it may be used in public restrooms, hotels, restaurants, or at a work place. Because the padded seat cover may also be easily wash and sanitized, the user may easily store and travel with the padded seat cover.

The present disclosure has been described with reference to exemplary embodiments. Obviously, modifications and alterations will occur to others upon reading and understanding the preceding detailed description. It is intended that the appended claims be construed as including all such modifications and alterations.

The invention claimed is:

1. A padded seat cover for covering a toilet seat which prevents a user's skin from directly contacting a toilet seat comprising:

a top layer having an outer edge portion and an inner edge portion disposed substantially uniformly therefrom, wherein the top layer further extends between said inner edge portion and said outer edge portion of said top layer, the top layer includes a textured surface;

a bottom layer having an outer edge and an inner edge disposed substantially uniformly therefrom, where the bottom layer further extends between said inner edge and said outer edge of said bottom layer;

a gripping member attached to the bottom layer for removably securing the padded seat cover onto a toilet seat wherein said gripping member comprises a lip that forms around said toilet seat;

a middle layer disposed between the top layer and bottom layer, where the middle layer further extends between the inner edge portion and outer edge portion of the top layer and the outer edge and inner edge of the bottom layer wherein said middle layer comprises a cavity filled with fluid; and a plurality of cavities disposed substantially uniformly across the top layer and extending through at least the top layer, where the plurality of cavities evenly maintain the padded seat cover at room temperature.

2. The padded seat cover according to claim 1, wherein the textured surface prevents the user's skin from sticking to the top layer.

3. The padded seat cover according to claim 1, wherein the top layer is formed from a non-adhering water resistant material, a non-slip material, a foam or gel cushioning material, or a combination of these materials.

4. The padded seat cover according to claim 3, wherein the non-adhering water resistant material includes an elastomer, polymer, or silicone.

5. The padded seat cover according to claim 1, wherein the bottom layer is formed from a non-adhering water resistant material, a foam or gel cushioning material, or a combination of these materials.

6. The padded seat cover according to claim 3, wherein non-adhering water resistant material, non-slip material, foam or gel cushioning material, or combination of those materials allow the padded seat cover to be easily cleaned or sanitized.

7. The padded seat cover according to claim 5, wherein the non-adhering water resistant material includes an elastomer, polymer, or nylon.

8. The padded seat cover according to claim 1, wherein the gripping member securely engages the toilet seat when placed thereon, preventing the padded seat cover from detaching or shifting after repeated use.

9. The padded seat cover according to claim 8, wherein the gripping member is a sleeve or apron.

10. The padded seat cover according to claim 1, wherein the middle layer is formed from a foam, gel or other natural fiber cushioning material.

11. The padded seat cover according to claim 1, wherein the fluid filling the hollow cavity includes liquid or air.

12. The padded seat cover according to claim 1, wherein the middle layer is capable of being inflated.

13. A method for making a padded seat cover comprising the steps of:

providing a top layer having an outer edge portion and an inner edge portion being disposed substantially uniformly therefrom, the top layer including a textured surface;

providing a bottom layer having an outer edge and an inner edge being disposed substantially uniformly therefrom;

attaching a gripping member to the bottom layer for removably securing the padded seat cover onto a toilet seat wherein said gripping member comprising one of a sleeve or apron;

providing a middle layer being disposed between the top layer and bottom layer, the middle layer further extending between the inner edge portion and outer edge portion of the top layer and the outer edge and inner edge of the bottom layer wherein said middle layer is inflatable;

providing a plurality of cavities being disposed substantially uniformly across the top layer and extending through at least the top layer, where the plurality of cavities evenly maintain the padded seat cover at room temperature.

* * * * *